US005354077A

United States Patent [19]

Soo

[11] Patent Number: 5,354,077

[45] Date of Patent: Oct. 11, 1994

[54] UNIVERSALLY ADJUSTABLE ICE SKATE BASE

[76] Inventor: Mike Soo, No. 403, Chung Shan Rd., Jen Teh Hsiang, Tainan Hsien, Taiwan

[21] Appl. No.: 64,503

[22] Filed: May 19, 1993

[51] Int. Cl.[5] ..... A63C 1/06

[52] U.S. Cl. ..... 280/11.12; 280/11.31

[58] Field of Search ..... 280/11.12, 11.26, 625, 280/629, 630, 11.36, 11.3, 11.31, 11.32, 11.33, 11.34

[56] References Cited

U.S. PATENT DOCUMENTS

| | | | |
|---|---|---|---|
| 68,558 | 9/1887 | Carmichael | 280/11.32 |
| D. 182,518 | 4/1958 | Jones | 280/11.12 |
| 503,624 | 8/1893 | Stayner | 280/11.12 |
| 544,172 | 8/1895 | Hinsch et al. | 280/11.12 |
| 1,212,855 | 1/1917 | Wachs | 280/11.12 |
| 2,170,162 | 8/1939 | Segal | 280/11.31 |

*Primary Examiner*—Richard M. Camby

*Attorney, Agent, or Firm*—Poms, Smith, Lande & Rose

[57] ABSTRACT

An ice skate base includes a base with an underside to which an ice blade is securely attached. Front and rear holder assemblies are respectively mounted to front and rear portions of the base and are adjustable in the longitudinal direction of the base to suit skaters of different sizes of feet. The front holder assembly further has pivotable arcuate plates so as to be adjusted to suit different feet shapes and to suit a right foot or left foot's shape as desired.

5 Claims, 5 Drawing Sheets

UNIVERSALLY ADJUSTABLE ICE SKATE BASE

BACKGROUND OF THE INVENTION

The present invention relates to a universally adjustable ice skate base and, more particularly, to an ice skate base which is adjustable in length and can be selectively adjusted to suit a right foot or left foot and to suit different foot shapes.

In the manufacturing, assembling, packaging, and wearing of ice skates, different sizes of feet and different shapes between right and left feet have been long and unsolved problems. To obviate the aforementioned problems, the present invention provides an improved ice skate base which is adjustable to suit different sizes of feet. Furthermore, the ice skate base can be selectively adjusted to suit a right foot or a left foot. In addition, the ice skate base can be adjusted to suit different foot shapes.

SUMMARY OF THE INVENTION

The present invention provides an ice skate base which includes a base with an underside to which an ice blade is securely attached. Front and rear holder assemblies are respectively mounted to front and rear portions of the base, to define a space for receiving a skater's footwear therein. At least one of the front and rear holder assemblies is adjustable in the longitudinal direction of the base so as to suit different sizes of skaters' feet.

The front holder assembly further includes pivotable arcuate members at both sides thereof. The user may pivot the arcuate members to suit his/her foot's shape. In addition, the user may pivot the arcuate members to convert a left foot skate to a right foot skate, and vice versa.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
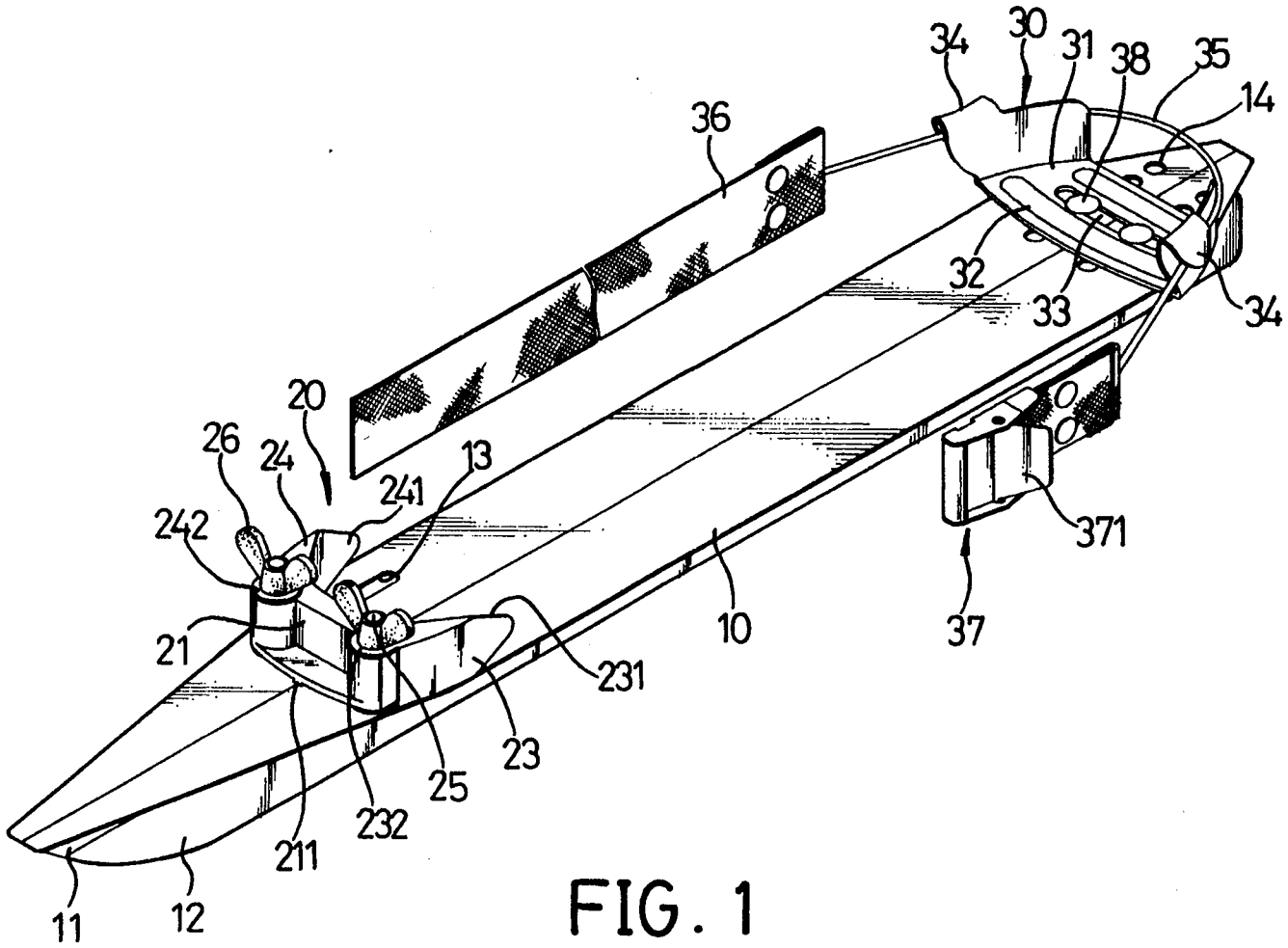
FIG. 1 is a perspective view of an ice skate base in accordance with the present invention.
Figure 2:
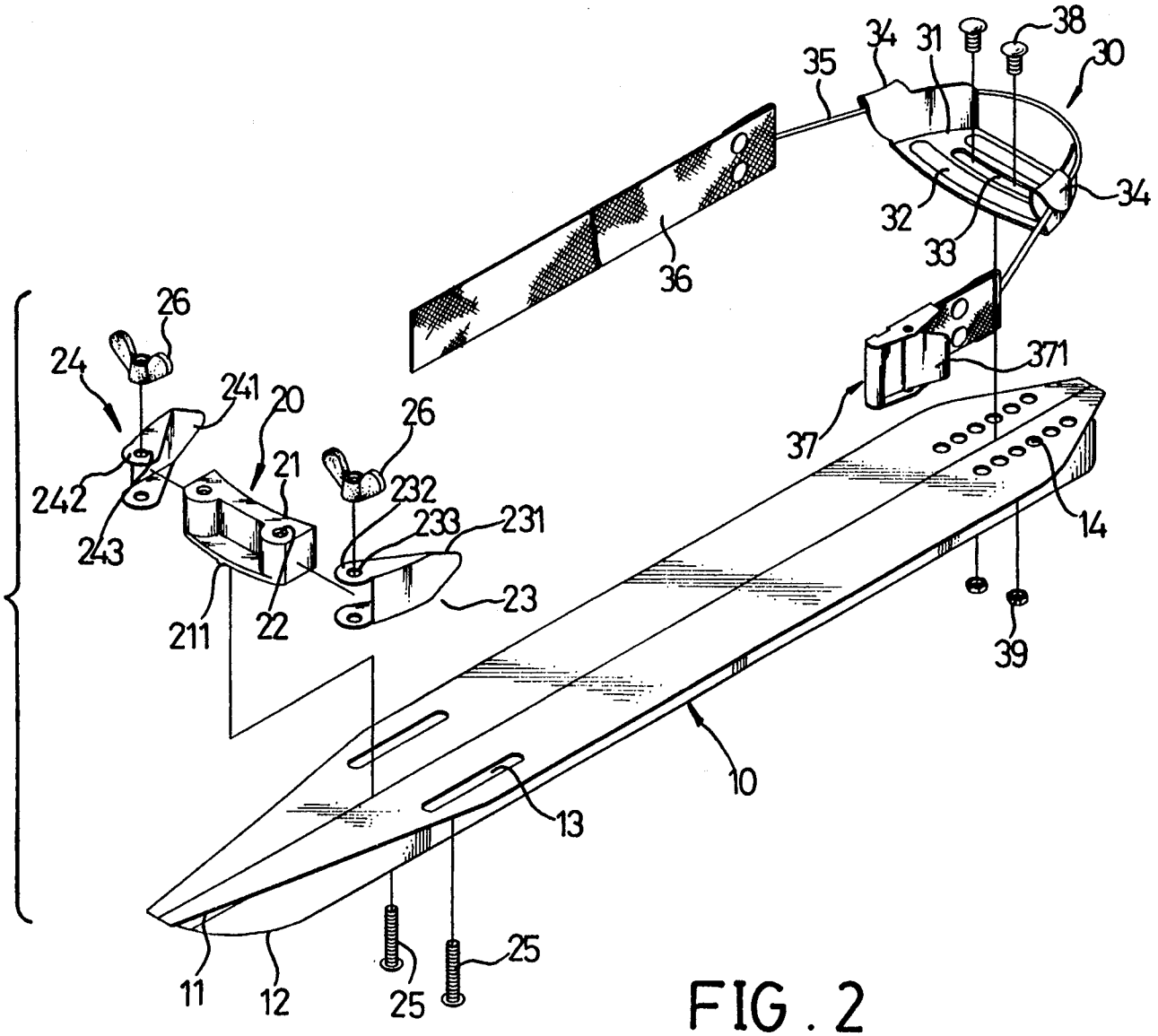
FIG. 2 is an exploded view of the ice skate base.

Referring to the drawings and initially to FIGS. 1 and 2, an ice skate base in accordance with the present invention generally includes a base 10 with two flanges 11 extending longitudinally along a center portion of an underside thereof. The two flanges 11 define a gap therebetween in which a top end of an ice blade 12 is mounted. A pair of elongate spaced holes 13 extend longitudinally in each side of a front portion o the base 10. A plurality of pairs of spaced holes 14 are provided in both sides of a rear portion of the base 10.

A front holder assembly 20 is adjustably mounted to the front portion of the base 10, including a block 21 which has a pair of spaced vertical holes 22. The distance between the vertical holes 22 is the same as that between the elongate holes 13. A pair of arcuate members 23 and 24 are provided, each includes an arcuate plate 231, 241 and two parallelly spaced ears 232 projecting horizontally outward from one end of each arcuate plate 231, 241. The distance between each of the pair of ears 232, 242 is approximately the same as the height of the block 21 such that both sides of the block 21 can be fittingly received between associated ears 232, 242. In assembling, both sides of the block 21 are firstly received between associated ears 232, 242. Thereafter, screws 25 are passed from the underside of the base 10 upward through the elongate holes 13, the holes 22 and 233, 243 in the ears 232, 242 of the arcuate members 23, 24. A butterfly nut 26 is finally provided to fasten associated arcuate members 23, 24 and the block 21 in position. Preferably, a protrusion 211 projects from a bottom side of the block 21 to provide a smooth motion of the block 21 on the base 10 during adjustment thereof.

Figure 4:
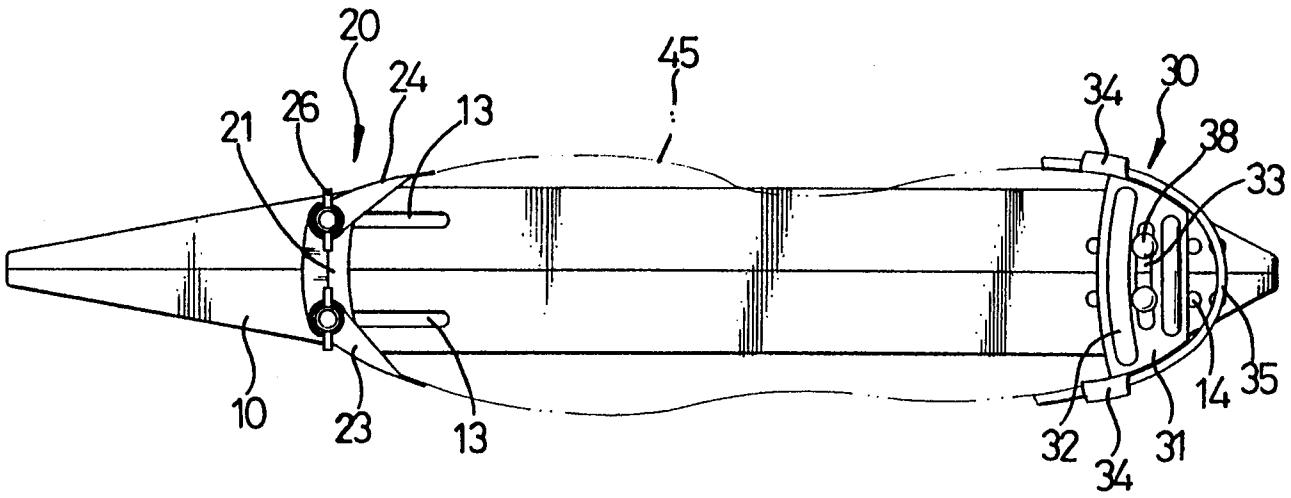
FIG. 4 is a top plan view of the ice skate base in which the ice skate base is adjusted to suit a left footwear.
Figure 5:
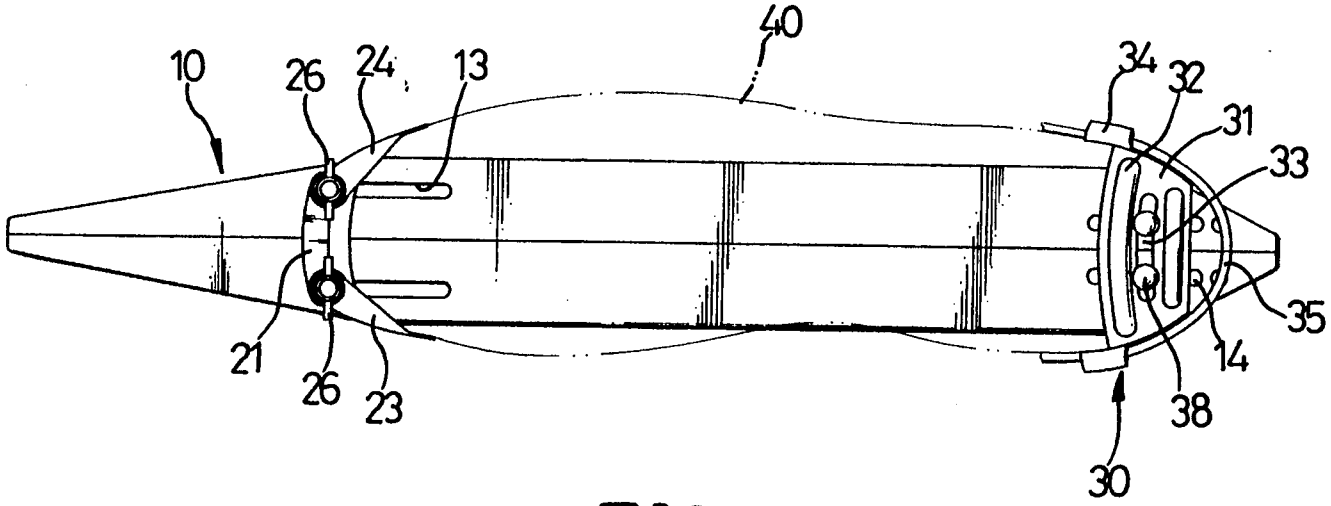
FIG. 5 is a top plan view of the ice skate base in which the ice skate base is adjusted to suit a right footwear.

Adjustment of the front holder assembly 20 is as follows: first, unscrewing the butterfly nuts 26 to allow a longitudinal movement of the block 21 in the elongate holes 13 until a desired position is reached (see FIG. 3), and then rescrewing the butterfly nuts 26 to position the block 21. When adjusting the angle of the arcuate members 23 and 24, the butterfly nuts are slightly unscrewed to allow pivotal movements of the arcuate plates 23 and 24 relative to the block 21. The user may pivot the arcuate members 23 and 24 to a status shown in FIG. 4 so as to suit a left footwear, such as a left sport shoe 45. Alternatively, the user may pivot the arcuate members 23 and 24 to a status shown in FIG. 5 so as to suit a right footwear, such as a right sport shoe 40. Additionally, the user may pivot the arcuate members 23 and 24 to suit the shapes of his right and left feet.

Figure 3:
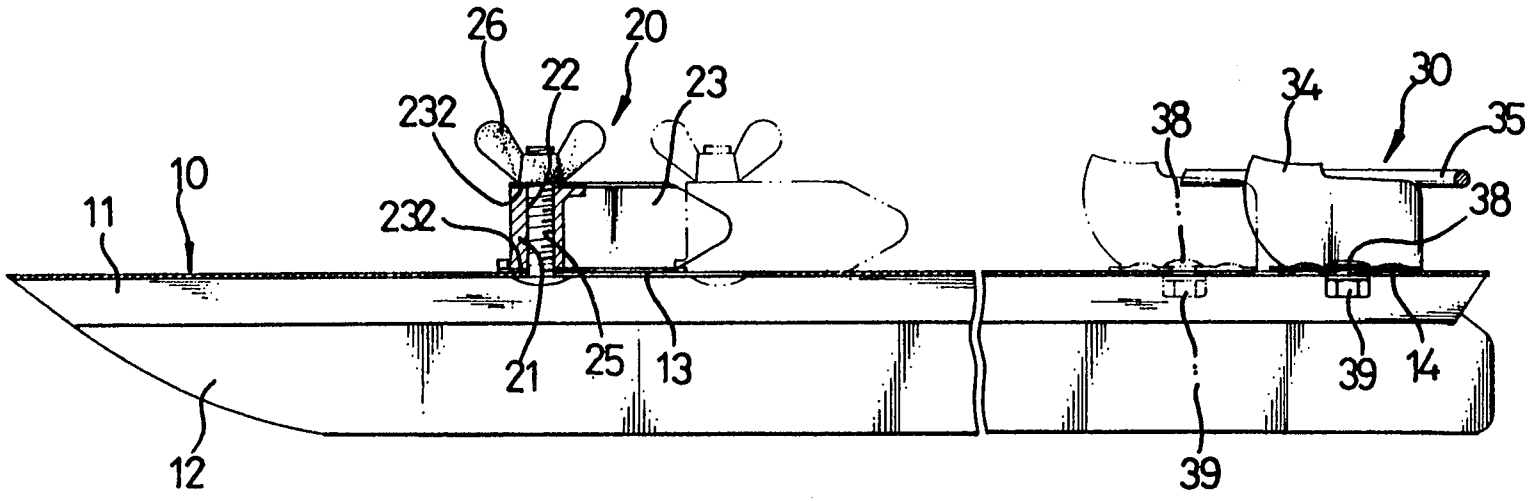
FIG. 3 is a cross-sectional side view of the ice skate base.

Still referring to FIGS. 1 and 2, the ice skate base in accordance with the present invention also includes a rear holder assembly 30 which, in turn, includes a bottom plate 31 on which a heel portion of a footwear locates. Preferably, two reinforced strips 32 are formed on the bottom plate 31 to support the skater. An elongate hole 33 is formed between the reinforced strips 32 and extends transverse to the longitudinal axis of the base 10 so as to align with one of the pairs of holes 14. A guiding strip 34 extends upward from each side of the bottom plate 31 and forms a substantially U-shaped end for guiding a cable 35 whose first end is secured to a first end of a strap 36 and whose second end is secured to a buckle 37 with a movable clamping plate 371 which, in turn, has serrated teeth (not shown) to clamp a second end of the strap 36. The strap 36 and buckle 37, as well as the cable 35 serve as a binding means to bind the ankle of the skater to the base 10. It is appreciated that other types of binding means can be used to achieve the same result. In assembling, as shown in FIG. 3, a pair of screws 38 are passed through one pair of holes 14 and the elongate hole 33 to secure the rear holder assembly in position by a pair of nuts 39. In adjustment, the user may simply unscrew the screws and reposition the screws in a suitable pair of holes 14.

From the above description, it is clear that the present invention provides an ice skate base which simplifies the procedure of manufacturing, assembling, and packaging of skates and, of course, reduces the costs therefor. When in use, the skate base may be longitudinally adjusted to suit skaters with different sizes of feet. Furthermore, due to the provision of the pivotable arcuate plates, the skate base in accordance with the present invention is suitable to skaters with different feet shapes. Moreover, in accordance with the present invention, a right foot skate may be adjusted to become a left foot skate, and vice versa.

Although the invention has been explained in relation to its preferred embodiment, it is to be understood that many other possible modifications and variations can be made without departing from the spirit and scope of the invention as hereinafter claimed.

I claim:

1. An ice skate base comprising:

a base having front and rear portions:

a front and rear holder assemblies respectively mounted on said front and rear portions of said base, defining a space therebetween for receiving a skater's footwear, at least one of said front and rear holder assemblies being adjustable in position along a longitudinal direction of said base; said front holder assembly including a block and a pair of arcuate members pivotally mounted to both sides of said block; and front and rear fastening means for respectively mounting said front and rear holder assembles in said longitudinal position; said front fastening means including a pair of spaced elongate holes provided in said front portion and extending along said longitudinal direction of said base, said block having a vertical hole in each side thereof, and screw and nut fasteners for fastening said block in position.

2. The ice skate base as claimed in claim 1 wherein each said arcuate member includes an arcuate plate with two ears extending horizontally outward from an end thereof for receiving one of said sides of said base, each of said ears having a hole vertically aligned with each other.

3. The ice skate base as claimed in claim 1 wherein said rear fastening means includes a plurality of pairs of spaced holes formed in said rear portion and aligned along said longitudinal direction of said base, and said rear holder assembly includes a bottom plate with an elongate hole extending along a direction transverse to said longitudinal direction and screw and nut fasteners for fastening said bottom plate in a position in which said elongate hole of said bottom aligns with one of said pairs of holes in said base.

4. An ice skate base comprising:

a base with front and rear portions;

front and rear holder assemblies respectively mounted on said front and rear portions of said base, defining a space therebetween for receiving a skater's footwear, at least one of said front and rear holder assemblies being adjustable in position along a longitudinal direction of said base, said rear holder assembly including a bottom plate with an elongate hole extending along a direction transverse to said longitudinal direction, a cable with first and second ends, a buckle attached to said first end of said cable, and a strap having a first end attached to said second end of said cable and a second end for releasably engaging with said buckle;

a plurality of pairs of spaced holes formed in said rear portion and aligned along said longitudinal direction of said base for respectively mounting said front and rear holder assemblies in said longitudinal position; and screw and nut fasteners for fastening said bottom plate in a position in which said elongate hole of said bottom aligns with one of said pairs of holes in said base.

5. The ice skate as claimed in claim 4 wherein a guiding strip extends from each said of said bottom plate and forms a substantially U-shaped end to guide said cable.

* * * * *